US005325549A

United States Patent [19]

Cornwall

[11] Patent Number: 5,325,549

[45] Date of Patent: Jul. 5, 1994

[54] TRAP FITTING ASSEMBLY FOR MOUNTING IN FLAMMABLE FLOORS

[76] Inventor: Kenneth R. Cornwall, 4963 Springfield Dr., Dunwoody, Ga. 30338

[21] Appl. No.: 40,578

[22] Filed: Mar. 31, 1993

Related U.S. Application Data

[63] Continuation of Ser. No. 700,406, May 15, 1991, abandoned.

[51] Int. Cl.[5] ..... E03C 1/20

[52] U.S. Cl. ..... 4/679; 4/696

[58] Field of Search ..... 4/191, 252 R, 584, DIG. 7, 4/679, 696, 252.1; 137/362, 247.41-247.51; 285/64

[56] References Cited

U.S. PATENT DOCUMENTS

| | | | |
|---|---|---|---|
| 404,271 | 5/1889 | Follansbee | 137/362 |
| 1,338,079 | 4/1920 | Hirst | 137/247.47 |
| 1,686,926 | 10/1928 | Rich | 137/247.43 |
| 3,382,508 | 5/1968 | Kammermeyer | 4/679 |
| 3,504,383 | 4/1970 | Young | 4/696 |
| 3,583,003 | 6/1971 | Thompson | 4/679 |
| 4,162,546 | 7/1979 | Shortell | 4/696 |
| 4,338,688 | 7/1982 | Petty | 4/696 |
| 4,403,355 | 9/1983 | Petty | 4/679 |
| 4,724,858 | 2/1988 | Cornwall | 137/75 |
| 4,823,527 | 4/1989 | Harbeke | 285/64 X |
| 4,920,582 | 5/1990 | Alker | 4/683 |
| 4,953,235 | 9/1990 | Cornwall | 4/679 |

*Primary Examiner*—William A. Cuchlinski, Jr.
*Assistant Examiner*—John L. Beres
*Attorney, Agent, or Firm*—Ian C. McLeod

[57] ABSTRACT

An improved trap fitting assembly (10) which prevents the spread of smoke and fire through a floor (100) and ceiling (104) supported by a joist (102) in a building is described. The fitting is preferably adapted for mounting in a tub box (12) and uses a flammable T-connector (24) for draining a tub (106) through an overflow pipe (22) and a drain pipe (20) connected to a tub drain (42). The T-connector is mounted inside of a non-flammable threaded nipple (16) which is mounted in an opening (14) in the tub box by jam nut (26) and a ring gasket (28). A non-flammable J-pipe (30), filled with water to a level L—L, threads onto a lower extension (**16*b***) of the nipple and prevents smoke and fire from spreading through the fitting assembly.

21 Claims, 2 Drawing Sheets

TRAP FITTING ASSEMBLY FOR MOUNTING IN FLAMMABLE FLOORS

Figure 1:
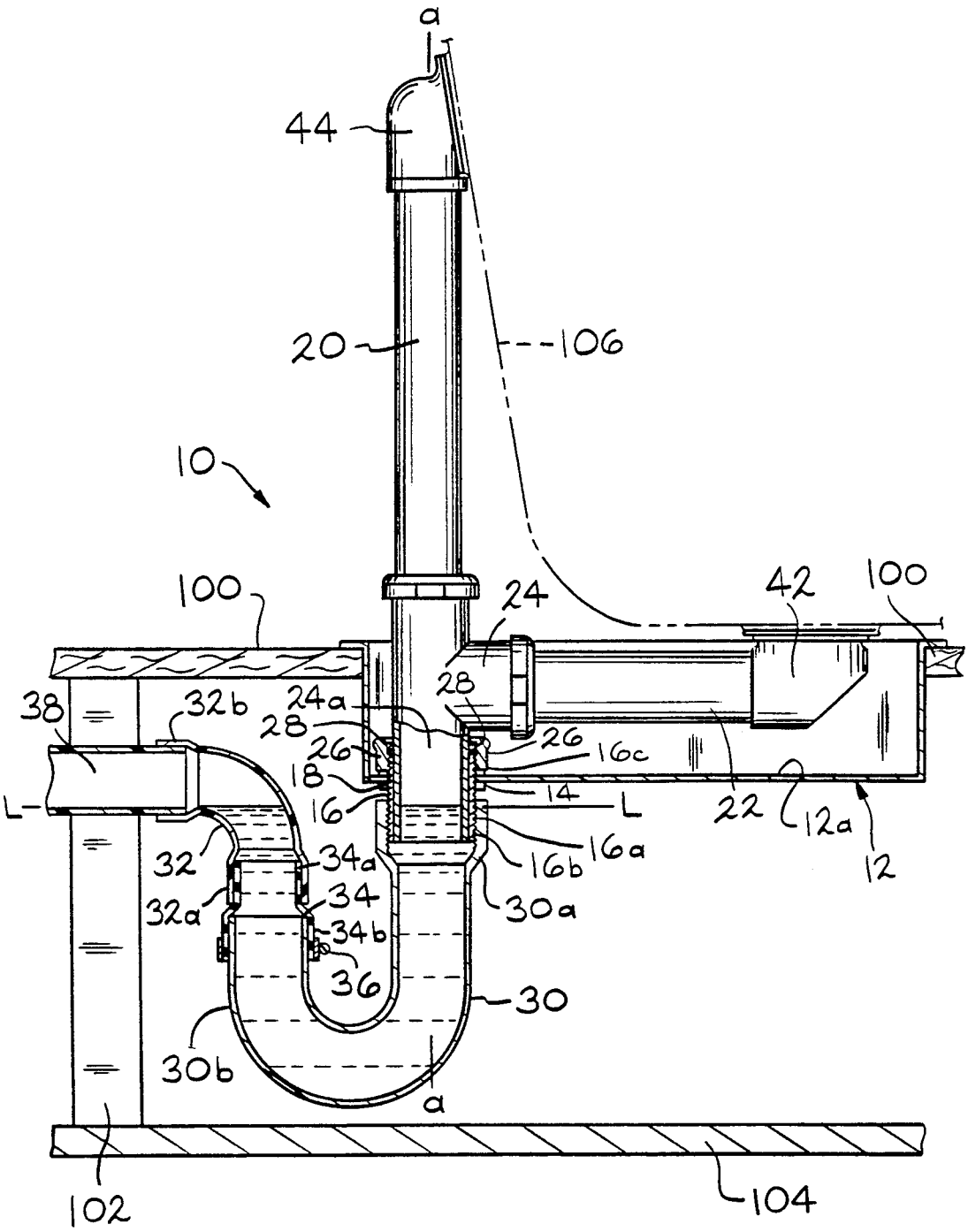

This is a continuation of copending application Ser. No. 07/700,406 filed on May 15, 1991 now abandoned.

BACKGROUND OF THE INVENTION (1) Field of the Invention

The present invention relates to an improved trap fitting assembly which prevents smoke and fire from spreading through the fitting which is preferably mounted through a tub box mounted in a flammable floor. In particular, the present invention relates to a trap fitting assembly including a flammable T-connector mounted inside of a non-flammable threaded nipple which extends part of the way through an opening in the bottom of a tub box or other non-flammable support means that is mounted in the floor. A non-flammable J-pipe is connected to an extension portion of the threaded nipple below the tub box. Water is trapped in the J-pipe so that any smoke or fire burning in a building will not be able to travel through the J-pipe, the threaded nipple or the tub box.

(2) Prior Art

Trap fitting assemblies are well known and generally include a non-flammable main conduit which penetrates a floor along a vertical longitudinal axis and a non-flammable J-pipe which is connected to a lower most end of the main conduit Generally, the J-pipe is provided through a pre-formed opening in the floor which is larger in diameter than the conduit. The J-pipe is preferably held in place by drain or tub box structure mounted on or in the floor. This construction is expensive.

My U.S. Pat. No. 4,724,858 describes a firestop stack fitting for sealing the opening of pipes which extend between floors of a building. A non-flammable sleeve is mounted inside a flammable coupling. This fitting works well where a trap is not required.

My U.S. Pat. No. 4,953,235 describes a trap fitting assembly, preferably adapted for a floor drain outlet or tub box, which prevents the spread of fire and smoke through a concrete floor of a building. The fitting uses a flammable coupling embedded in a poured concrete floor. A non-flammable sleeve inside the coupling has an extension portion extending below the floor. A non-flammable J-pipe contains water at a level above the trough of the two upturned legs of the J-pipe. The J-pipe is connected to the extension portion and prevents smoke and fire from going through the floor. This trap fitting assembly is not adapted for use with flammable floors.

OBJECTS

It is therefore an object of the present invention to provide an improved trap fitting assembly and a building incorporating the trap fitting assembly in a flammable floor wherein smoke and fire are prevented from moving through the trap fitting assembly. Further, it is an object of the present invention to provide a trap fitting assembly that is simple to construct and inexpensive to build and which can preferably be mounted onto a drain enclosure or a tub box mounted in a floor of the building. These and other objects will become increasingly apparent by reference to the following descriptions and to the drawings.

IN THE DRAWINGS

FIG. 1 is a front partial sectional view of a trap fitting assembly 10 adapted for bathtub 106 mounted in a joist 102 and panel 100, and showing a flammable T-connector 24 mounted in a non-flammable threaded nipple 16 with a non-flammable J-pipe 30 threaded onto a lower extension **16*b*** of the nipple.

Figure 2:
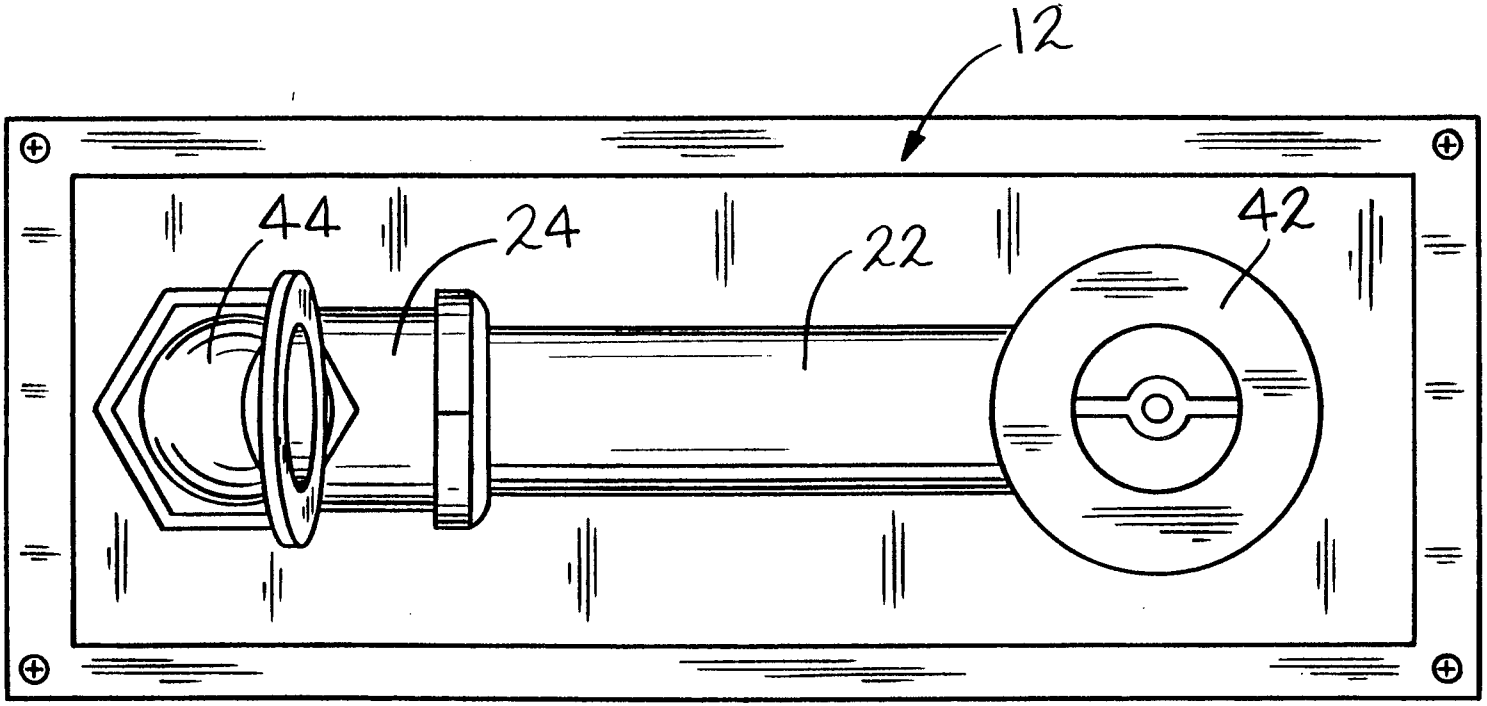

FIG. 2 is a plan view of the tub box 12 mounted in the floor 100 showing an overflow pipe 20 and a drain pipe 22 with tub drain 42 connected to the T-connector 24 which is mounted in the tub box with a jam nut 26.

GENERAL DESCRIPTION

The present invention relates to an improved trap fitting assembly which prevents smoke and fire from spreading through a flammable floor of a building through the trap fitting assembly which comprises: a non-flammable support means adapted for mounting in an opening in the floor; a non-flammable nipple means mounted in an opening through the support means, the nipple means having opposed ends with an inside wall forming an opening along a longitudinal axis between the ends and with the nipple means having an outside wall secured to the opening in the support means, wherein an extension of the nipple means projects below the support means; a flammable, elongated pipe means having opposed upper and lower open ends along the axis, the lower end of the pipe means mounted on the inside wall of the nipple; and a non-flammable J-pipe means removably mounted to the extension of the nipple means below the opening in the support means by a connection means, wherein in use the J-pipe means is filled with water in a lower portion of the J-pipe means thereby preventing smoke and fire from moving through the nipple means and the pipe means.

In particular, the present invention relates to an improved trap fitting assembly which prevents smoke and fire from spreading through a flammable floor of a building through the trap fitting assembly which comprises: a non-flammable tub box means adapted for mounting in an opening in the floor; a non-flammable nipple means mounted in an opening through the tub box means, the nipple means having opposed ends with an inside wall forming an opening along a longitudinal axis between the ends and with the nipple means having an outside wall secured to the opening in the tub box means and wherein an extension of the nipple means projects below the tub box means; a flammable, elongated pipe means having opposed upper and lower open ends along the axis, the lower end of the pipe means mounted on the inside wall of the nipple; and a non-flammable J-pipe means removably mounted to the extension of the nipple means below the opening in the tub box means by a connection means, wherein in use the J-pipe means is filled with water in a lower portion of the J-pipe means thereby preventing smoke and fire from moving through the nipple means and the pipe means.

Furthermore, the present invention relates to a building construction which prevents the spread of smoke and fire through a flammable floor of the building which comprises: an improved trap fitting assembly which prevents fire and smoke from spreading through a floor of a building through the trap fitting assembly which comprises: a non-flammable tub box means in an opening in the floor; a non-flammable nipple means mounted in an opening through the support means, the nipple means having opposed ends with an inside wall forming an opening along a longitudinal axis between the ends and with the nipple means having an outside wall secured to the opening in the support means, wherein an extension of the nipple means projects below the bottom wall of the support means; a flammable, elongated pipe means having opposed upper and lower open ends along the axis, the lower end of the pipe means mounted on the inside wall of the nipple means; and a non-flammable J-pipe means removably mounted to the extension of the nipple means below the opening in the tub box means by a connection means, wherein in use the J-pipe means is filled with water in a lower portion of the J-pipe means thereby preventing smoke and fire from moving up through the nipple means and the pipe means; a floor mounting of the support means with the non-flammable nipple means mounted in the opening through the bottom wall of the support means, the flammable, elongated pipe means mounted on the inside wall of the nipple means and the non-flammable J-pipe means removably secured to the extension of the nipple means at a lower most of the openings of the nipple means by the connection means; and a drain pipe connected to the J-pipe means to convey the water overflow from the J-pipe means through the building.

In particular, the present invention relates to a building construction which prevents the spread of smoke and fires through a flammable floor of the building which comprises: an improved trap fitting assembly which prevents fire and smoke from spreading through a floor of a building through the trap fitting assembly which comprises: a non-flammable tub box means in an opening in the floor; a non-flammable nipple means mounted in an opening through the tub box means, the nipple means having opposed ends with an inside wall forming an opening along a longitudinal axis between the ends and with the nipple means having an outside wall secured to the opening in the tub box means, wherein an extension of the nipple means projects below the bottom wall of the tub box means; a flammable, elongated pipe means having opposed upper and lower open ends along the axis, the lower end of the pipe means mounted on the inside wall of the nipple means; and a non-flammable J-pipe means removably mounted to the extension of the nipple means below the opening in the tub box means by a connection means, wherein in use the J-pipe means is filled with water in a lower portion of the J-pipe means thereby preventing smoke and fire from moving through the nipple means and the pipe means; a floor mounting the tub box means with the non-flammable nipple means mounted in the opening through the bottom wall of the tub box means, the flammable, elongated pipe means mounted on the inside wall of the nipple means and the non-flammable J-pipe means removably secured to the extension of the nipple means at a lower most of the openings of the nipple means by the connection means; and a drain pipe connected to the J-pipe means to convey the water overflow from the J-pipe means through the building.

The trap fitting assembly is preferably part of a floor drain or a tub drain Other types of fittings, assemblies or support means for fluid draining through a floor can be used.

SPECIFIC DESCRIPTION

FIG. 1 shows the preferred trap fitting assembly 10 of the present invention. A metal tub box 12 is mounted in a panel forming floor 100 which is usually made of wood or other flammable materials but may have an overlay of tile or the like. An opening 14 is provided through a bottom wall 12*a* of the tub box for mounting an iron nipple 16 along the vertical axis a—a. The nipple 16 is threaded and sealed in the opening 14 in the bottom wall 12*a* of the tub box 12, by a threaded ring seal 18, preferably made of metal. The threaded nipple 16 has a threaded outside wall 16*a* with a lower extension 16*b* depending below the tub box 12 and an upper portion 16*c*.

As shown in FIGS. 1 and 2, the tub box 12 houses overflow pipe 20 and drain pipe 22 through a flammable T-connector 24. A lower end 24*a* of the T-connector 24 is mounted inside of the threaded nipple 16. The T-connector 24 is sealed to the threaded nipple 16 with a jam nut 26 and a ring gasket 28. The jam nut 26 mounts over the ring gasket 28 and the lower end 24*a* of the T-connector 24 and threads onto the upper portion 16*c* of the nipple 16 thereby sealing the T-connector 24 to the threaded nipple 16 with ring gasket 28. The jam nut 26 and the ring gasket 28 also prevent fluid in the tub box 12 from leaking between the outside of the threaded nipple 16 and the tub box 12.

A non-flammable J-pipe 30 has an enlarged upper end 30*a* and a lower end 30*b*. The upper end 30*a* of the J-pipe 30 is threaded for threadably mating with the lower extension 16*b* of the threaded nipple 16 while the lower end 30*b* of the J-pipe 30 is mated to a fluid carrying plastic elbow conduit 32 by a plastic or rubber coupling 34. An upper end 34*a* of the coupling 34 is solvent welded or bonded inside of a lower end 32*a* of the elbow conduit 32. A lower end 34*b* of the coupling 34 is enlarged and has a ring clamp 36 which mounts the coupling 34 on the lower end 30*b* of the J-pipe 30. The upper end 32*b* of the elbow conduit 32 is solvent welded or bonded to a fluid carrying conduit drain pipe 38 mounted through joist 102 for carrying fluid between the floor 100 of an upper story and a panel forming a ceiling 104 of a lower story of a building (not shown). The ceiling 104 is optional, however, usually it is made of gypsum or another fire rated material and slows the spread of fire to the floor 100 above.

As can be seen in FIG. 1, the drain pipe 22 is recessed into the tub box 12 so that a bathtub 106 will mount properly with a tub drain 42 at the proper level. Also, an overflow drain 44 is mounted on the overflow pipe 20 and connected to the bathtub 106. In use, the water level L—L is such that when the non-flammable J-pipe 30 mounts onto the lower portion 16*b* of the non-flammable nipple 16 which is mounted in the metal tub box 12, smoke and fire are prevented from going through the J-pipe 30 particularly from a lower story of a building to a higher story before the fire has actually burned through the ceiling 104 and the floor 100.

It is intended that the foregoing description be only illustrative of the present invention and that the present invention be limited only by the hereinafter appended claims.

I claim:

1. An improved trap fitting assembly which prevents smoke and fire from spreading through a flammable floor of a building through the trap fitting assembly which comprises:

(a) a non-flammable support means adapted for mounting in an opening in the floor;

(b) a non-flammable nipple in the form of a short segment of pipe mounted in an opening through the support means, the nipple having opposed ends with an inside wall forming an opening along a longitudinal axis between the ends and with the nipple having an outside wall threaded along the length of the nipple and secured to the opening in the support means by a threaded non-flammable ring seal, wherein an extension of the nipple projects below the support means;

(c) a flammable, elongated pipe mounted above the nipple having opposed upper and lower open ends along the axis, the lower end of the pipe mounted on the inside wall of the nipple and secured to the inside wall of the nipple by a jam nut threadably mounted on the outside wall of the nipple wherein a ring gasket is mounted adjacent the jam nut so as to form a waterproof seal between the outside wall of the nipple and the opening of the support means to prevent water from leaking between the outside wall of the nipple and the opening of the support means; and (d) a non-flammable J-pipe removably mounted to the extension of the nipple below the opening in the support means by a connection means, wherein the nipple provides a non-flammable connector between the J-pipe and the support means such as to prevent the J-pipe from separating from the support means during a fire and wherein in use the J-pipe is filled with water in a lower portion of the J-pipe thereby preventing smoke and fire from moving through the nipple.

2. The trap fitting assembly of claim 1 wherein the support means has rectangular cross-section with opposed sidewalls extending from a rectangular bottom wall and spaced apart end walls between the sidewalls with lip means extending from the end wall and the sidewalls, opposite the bottom wall for hanging the support means in the opening in the floor.

3. An improved trap fitting assembly which prevents smoke and fire from spreading through a flammable floor of a building through the trap fitting assembly which comprises:

(a) a non-flammable tub box adapted for mounting in an opening in the floor;

(b) a non-flammable nipple in the form of a short segment of pipe mounted in an opening through the tub box, the nipple having opposed ends with an inside wall forming an opening along a longitudinal axis between the ends and with the nipple having an outside wall threaded along the length of the nipple and secured to the opening in the tub box by a threaded, non-flammable ring seal, wherein an extension of the nipple projects below the tub box;

(c) a flammable, elongated pipe mounted above the nipple having opposed upper and lower open ends along the axis, the lower end of the pipe mounted on the inside wall of the nipple and secured to the inside wall of the nipple by a jam nut threadably mounted on the outside wall of the nipple wherein a ring gasket is mounted adjacent the jam nut so as to form a waterproof seal between the outside wall of the nipple and the opening of the tub box to prevent water from leaking between the outside wall of the nipple and the opening of the tub box; and (d) a non-flammable J-pipe removably mounted to the extension of the nipple below the opening in the tub box by a connection means wherein the nipple provides a non-flammable connector between the J-pipe and the tub box such as to prevent the J-pipe from separating from the tub box during a fire and, wherein in use the J-pipe is filled with water in a lower portion of the J-pipe thereby preventing smoke and fire from moving through the nipple and the pipe.

4. The trap fitting assembly of claim 3 wherein the tub box has a rectangular cross-section with opposed sidewalls extending from a rectangular bottom wall and spaced apart end walls between the sidewalls with lip means extending from the end walls and the sidewalls, opposite the bottom wall for hanging the tub box in the opening in the floor.

5. The trap fitting assembly of claim 4 wherein the tub box is metal.

6. The trap fitting assembly of claim 3 wherein the pipe is composed of a plastic and is secured to the nipple by a jam nut.

7. The trap fitting assembly of claim 6 wherein a gasket is sealed along an outside wall of the pipe adjacent the nipple by the jam nut.

8. The trap fitting assembly of claim 7 wherein the lower end of the pipe projects below the tub box substantially the length of the nipple.

9. The trap fitting assembly of claim 3 wherein the outside wall of the nipple is threadably mated to the J-pipe to form the connection means.

10. The trap fitting assembly of claim 3 wherein tub connecting pipes for an overflow and for a drain are provided on the upper end of the pipe means.

11. A building construction which prevents the spread of fires and smoke through a flammable floor of the building which comprises:

(a) an improved trap fitting assembly which prevents fire and smoke from spreading through a floor of a building through the trap fitting assembly which comprises: a non-flammable support means in an opening in the floor; a non-flammable nipple in the form of a short segment of pipe mounted in an opening through the support means, the nipple having opposed ends with an inside wall forming an opening along a longitudinal axis between the ends and with the nipple having an outside wall threaded along the length of the nipple and secured to the opening in the support means by a threaded non-flammable ring seal, wherein an extension of the nipple projects below the bottom wall of the support means; a flammable, elongated pipe mounted above the nipple having opposed upper and lower open ends along the axis, the lower end of the pipe mounted on the inside wall of the nipple and secured to the inside wall of the nipple by a jam nut threadably mounted on the outside wall of the nipple wherein a ring gasket is mounted adjacent the jam nut so as to form a waterproof seal between the outside wall of the nipple and the opening of the support means to prevent water from leaking between the outside wall of the nipple and the opening of the support means; and a non-flammable J-pipe removably mounted to the extension of the nipple below the opening in the tub box by a connection means wherein the nipple provides a non-flammable connector between the J-pipe and the support means such as to prevent the J-pipe from separating from the tub box during a fire and, wherein in use the J-pipe is filled with water in a lower portion of the J-pipe thereby preventing smoke and fire from moving up through the nipple and the pipe;

(b) a floor mounting of the support means with the non-flammable nipple mounted in the opening through the bottom wall of the support means, the flammable, elongated pipe mounted on the inside wall of the nipple and the non-flammable J-pipe removably secured to the extension of the nipple at a lower most of the openings of the nipple by the connection means; and (c) a drain pipe connected to the J-pipe to convey the water overflow from the J-pipe through the building.

12. The building construction of claim 11 wherein the support means has rectangular cross-section with opposed sidewalls extending from a rectangular bottom wall and spaced apart end walls between the sidewalls with lip means extending from the end walls and the sidewalls, opposite the bottom wall for hanging the support means in the opening in the floor.

13. A building construction which prevents the spread of smoke and fire through a flammable floor of the building which comprises:

(a) an improved trap fitting assembly which prevents fire and smoke from spreading through a floor of a building through the trap fitting assembly which comprises: a non-flammable tub box in an opening in the floor; a non-flammable nipple in the form of a short segment of pipe mounted in an opening through the tub box, the nipple having opposed ends with an inside wall forming an opening along a longitudinal axis between the ends and with the nipple having an outside wall threaded along the length of the nipple and secured to the opening in the tub box by a threaded non-flammable ring seal, wherein an extension of the nipple projects below the bottom wall of the tub box; a flammable, elongated pipe mounted above the nipple having opposed upper and lower open ends along the axis, the lower end of the pipe mounted on the inside wall of the nipple and secured to the inside wall of the nipple by a jam nut threadably mounted on the outside wall of the nipple wherein a ring gasket is mounted adjacent the jam nut so as to form a waterproof seal between the outside wall of the nipple and the opening of the tub box to prevent water from leaking between the outside wall of the nipple and the opening of the tub box; and a non-flammable J-pipe removably mounted to the extension of the nipple below the opening in the tub box by a connection means wherein the nipple provides a non-flammable connector between the J-pipe and the tub box such as to prevent the J-pipe from separating from the tub box during a fire and, wherein in use the J-pipe is filled with water in a lower portion of the J-pipe thereby preventing smoke and fire from moving through the nipple and the pipe;

(b) a floor mounting of the tub box with the non-flammable nipple mounted in the opening through the bottom wall of the tub box, the flammable, elongated pipe mounted on the inside wall of the nipple and the non-flammable J-pipe removably secured to the extension of the nipple at a lower most of the openings of the nipple by the connection means; and (c) a drain pipe connected to the J-pipe to convey water overflow from the J-pipe through the building.

14. The building construction of claim 13 wherein the tub box has a rectangular cross-section with opposed sidewalls extending from a rectangular bottom wall and spaced apart end walls between the sidewalls with lip means extending from the end wall and the sidewalls, opposite the bottom wall for hanging the tub box in the opening in the floor.

15. The building construction of claim 14 wherein the tub box is metal.

16. The building construction of claim 15 wherein the pipe is composed of a plastic and is secured in the nipple by a jam nut.

17. The building construction of claim 16 wherein a gasket is sealed along an outside wall of the pipe adjacent the nipple by the jam nut.

18. The building construction of claim 17 wherein the lower end of the pipe projects below the tub box substantially the length of the nipple.

19. The building construction of claim 13 wherein the outside wall of the nipple is threadably mated to the J-pipe as the connection means.

20. The building construction of claim 13 wherein tub connecting pipes for an overflow and for a drain are mounted on the upper end of the pipe means.

21. A method for constructing a building which prevents the spread of smoke and fire through a flammable floor of the building which comprises:

(a) providing an improved trap fitting assembly which prevents smoke and fire from spreading through the flammable floor of the building through the trap fitting assembly which comprises: a non-flammable support means adapted for mounting in an opening in the floor; a non-flammable nipple in the form of a short segment of pipe mounted in an opening through the support means, the nipple having opposed ends with an inside wall forming an opening along a longitudinal axis between the ends and with the nipple having an outside wall threaded along the length of the nipple and secured to the opening in the support means by a threaded non-flammable ring seal, wherein an extension of the nipple projects below the support means; a flammable, elongated pipe mounted above the nipple having opposed upper and lower open ends along the axis, the lower end of the pipe mounted on the inside wall of the nipple and secured to the inside wall of the nipple by a jam nut threadably mounted on the outside wall of the nipple wherein a ring gasket is mounted adjacent the jam nut so as to form a waterproof seal between the outside wall of the nipple and the opening of the support means to prevent water from leaking between the outside wall of the nipple and the opening of the support means; and a non-flammable J-pipe removably mounted to the extension of the nipple below the opening in the support means by a connection means wherein the nipple provides a non-flammable connector between the J-pipe and the support means such as to prevent the J-pipe from separating from the support means during a fire and, wherein in use the J-pipe is filled with water in a lower portion of the J-pipe thereby preventing smoke and fire from moving through the nipple and the pipe;

(b) cutting the opening in the floor and the opening in the support means;

(c) mounting in succession the support means in the opening in the floor, the nipple in the opening through the support means, the pipe on the inside wall of the nipple and the J-pipe on the extension of the nipple below the opening in the support means with a connection means;

(d) filling the J-pipe with water to prevent smoke and fire from moving through the nipple and the pipe; and (e) connecting a drain pipe to the J-pipe to convey water overflow from the J-pipe through the building.

* * * * *